United States Patent [19]

Hampshire et al.

[11] Patent Number: 4,549,767

[45] Date of Patent: Oct. 29, 1985

[54] ADJUSTABLE FOOT SUPPORT

[75] Inventors: James F. Hampshire, Stephens City, Va.; Beverly L. Wilkinson, Cincinnati, Ohio

[73] Assignee: Rubbermaid Commercial Products Inc., Winchester, Va.

[21] Appl. No.: 557,455

[22] Filed: Dec. 2, 1983

[51] Int. Cl.[4] ..... A47C 9/12

[52] U.S. Cl. ..... 297/439; 297/423

[58] Field of Search ..... 297/439, 423, 438; 248/454, 456

[56] References Cited

U.S. PATENT DOCUMENTS

| | | | |
|---|---|---|---|
| 2,912,046 | 11/1959 | Fuerst | 297/439 |
| 3,606,458 | 9/1971 | Attinger | 297/439 |
| 3,859,930 | 1/1975 | Sherinin | 297/439 |
| 4,441,432 | 4/1984 | Carlton | 248/456 |
| 4,441,758 | 4/1984 | Fleischer et al. | 297/439 |

*Primary Examiner*—James T. McCall

*Attorney, Agent, or Firm*—Renner, Kenner, Greive & Bobak Co.

[57] ABSTRACT

An adjustable foot support (10) includes a platform (38) upon which the feet may be placed and a base (14) to support the platform (38). A bracket assembly (26) extends upwardly from the base (14) and has a plurality of stepped channels (28) which selectively cooperate with a downwardly extending leg (41) from the platform (38) so that the platform (38) is selectively inclined with respect to the base (14).

6 Claims, 3 Drawing Figures

ADJUSTABLE FOOT SUPPORT

TECHNICAL FIELD

The present invention relates generally to office equipment and similar devices which improve the comforts and conveniences of the work environment. More specifically, the present invention relates to foot supports used to relieve foot, leg and back strain experienced by secretaries, typists, computer terminal operators and the like.

BACKGROUND ART

It is commonly experienced, by many office workers in particular, that prolonged periods of sitting may cause foot, leg and lower back strain. It is well known that such strain can be reduced by providing a foot support, typically located on the floor underneath the work station. To thereby produce effective results, the footrest should both elevate and inclinate the feet to a comfortable position.

A major design consideration is that the end users of a footrest may vary over a wide range of heights and body sizes. Previous efforts in making commercially available footrests at reasonable prices include making footrests which have a fixed height and angle of inclination predetermined by what would be comfortable for an average user. Such units may be undesirable as they accomplish their purpose only for that limited segment of the population which reasonably meets the average size criteria in that they cannot be adjusted to meet personal needs or preferences.

One attempt to design an adjustable footrest utilizes a slotted foot support which pivots on an axle or cam arrangement. The user may adjust the height of elevation and angle of inclination by loosening a turnhandle which allows the foot support to pivot. Once the desired position is obtained the turnhandle may be tightened. Numerous drawbacks accompany such a design. If the turnhandle is not reset tight enough the foot support could pivot from its desired position when placed under a load such as when the user rests his or her feet upon it. Furthermore, such a design necessitates substantial or repeated bending in order to adjust the position of the support or to turn the handle and also may require substantial strength to sufficiently tighten the turnhandle to prevent the foot support from slipping.

It is thus apparent that the state of the prior art is such that the need exists for a footrest which provides comfortable and convenient use by a wide variety of the end user population, which is easily adjustable to suit individual preferences and which requires minimal effort to accomplish the desired adjustments.

DISCLOSURE OF THE INVENTION

It is, therefore, the primary object of the present invention to provide a new and improved adjustable footrest.

It is another object of the present invention to provide an adjustable footrest which is suitably usable by many different persons of various weights and sizes.

It is yet another object of the present invention to provide a footrest which can be adjusted with minimal effort to meet the needs of different users.

It is still another object of the present invention to provide an adjustable footrest which will not vary its adjusted position under use but whose position is easily adjustable by the current user.

It is a further object of the present invention to provide an adjustable footrest which may be used to vary the elevation or angle of inclination of the user's feet and legs.

These and other objects are accomplished by the improvements comprising the present invention, a preferred embodiment of which is disclosed herein by way of example as comprising the best known mode for carrying out the invention. Various modifications and changes in details of construction are comprehended within the scope of the appended claims.

In general, an adjustable foot support includes a platform upon which the feet may be placed and a base to support the platform. A bracket assembly extends upwardly from the base and has a plurality of stepped channels which selectively cooperate with a downwardly extending leg from the platform so that the platform is selectively inclined with respect to the base.

PREFERRED EMBODIMENT OF THE INVENTION

Figure 1:
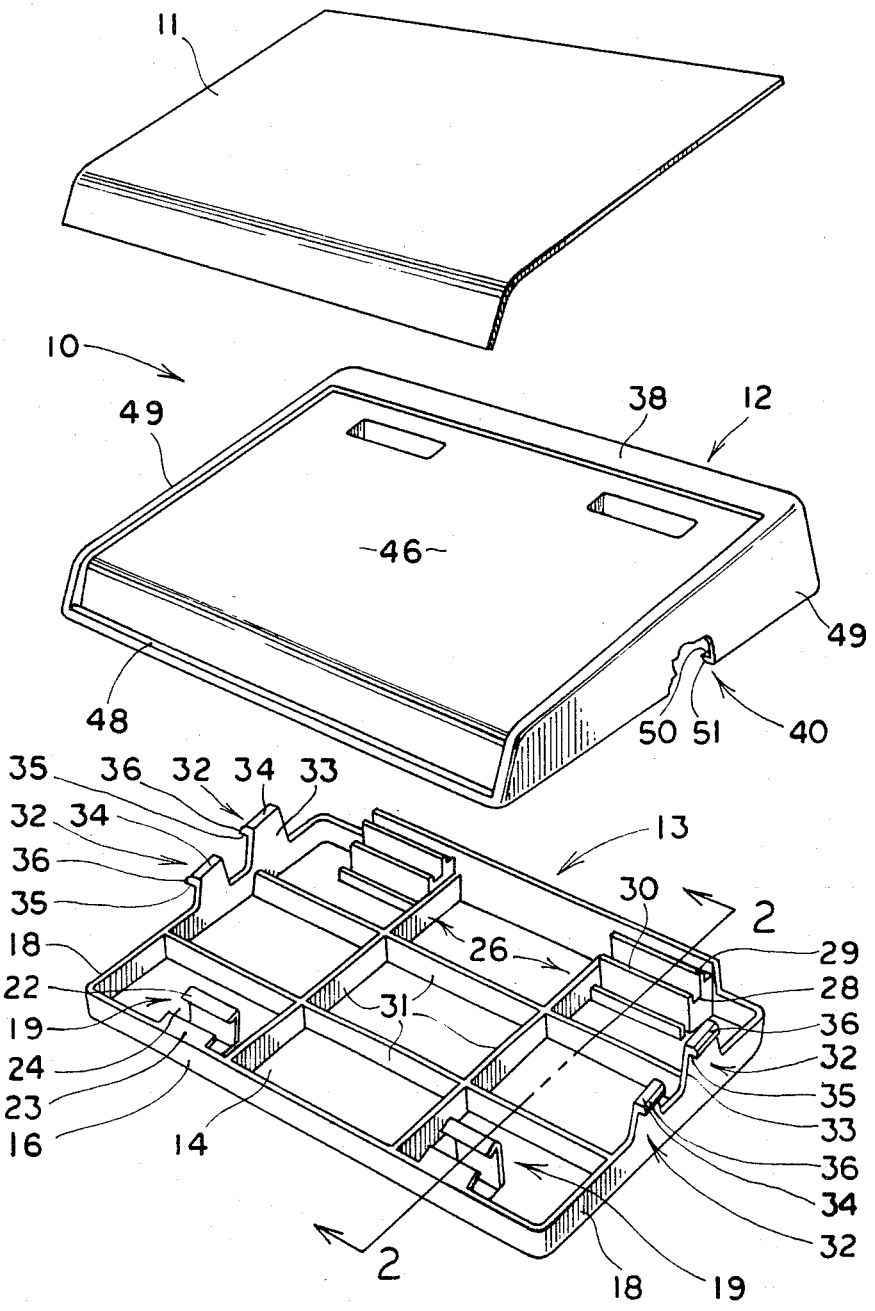
FIG. 1 is a partially cutaway, exploded perspective of an apparatus embodying the concepts of the present invention.

Referring to FIG. 1, a foot support apparatus according to the concepts of the present invention is generally indicated by the numeral 10. As shown, apparatus 10 may have a mat 11, an upper assembly 12 and a lower assembly 13. Upper and lower assemblies 12 and 13 may be made of any suitable material such as molded plastics which will provide sufficient durability and strength as a footrest. Mat 11 may be made from any suitable, preferably non-skid, material such as rubber or vinyl. While the preferred embodiment set forth herein describes the present invention with particularity as a foot support, such description should not be construed as limiting in any sense. The invention disclosed herein may have many other applications in which an adjustable, inclined surface is desirable such as keyboard turntables, book holders and the like; the invention being measured by the scope of the appended claims and not by the exemplary details of the specification.

Lower assembly 13 as shown in FIG. 1 includes a generally rectangular, flat base 14 which may have non-slip pads on the bottom (not shown) to prevent apparatus 10 from sliding on a floor or other surface. Along the perimeter of base 14 are four walls generally perpendicular to base 14, namely, back wall 15, a front wall 16 and a pair of inner side walls 18. All the walls may be of substantially the same height.

Figure 2:
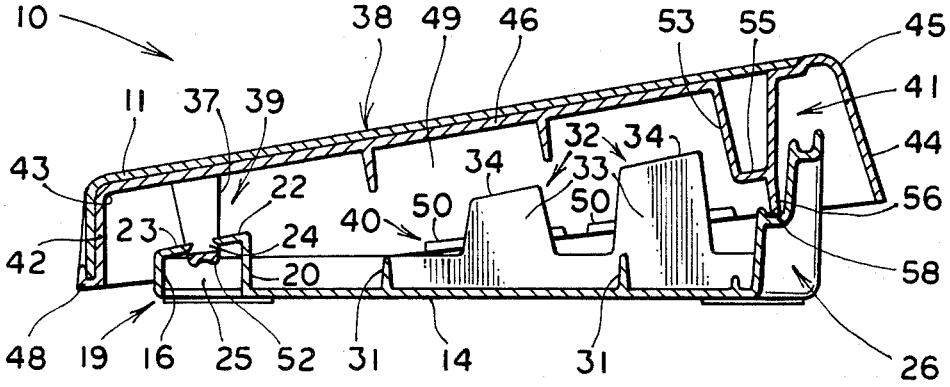
FIG. 2 is a sectional view of the apparatus shown in FIG. 1, as assembled taken substantially along line 2—2.

Located toward the front of base 14 are a plurality of hinge mechanisms 19, one positioned approximately near each forward corner of lower assembly 13. As best shown in FIG. 2, hinge assembly 19 includes a retaining wall 20 which is generally perpendicular to base 14, and somewhat higher than front wall 16. Wall 20 extends up from base 14 and carries an overhang 22 which slopes downward as well as forward. Overhang 22 may extend forward less than one-half the distance between retaining wall 20 and front wall 16.

A second overhang 23 extends upwardly and rearwardly of front wall 16. The slope of inclination of overhang 23 may be the same as that of overhang 22 such that the surfaces of overhangs 22 and 23 lie in the same spatial plane. Overhang 23 extends rearward less than one-half the distance between wall 20 and wall 16. Thus, a slot 24 is defined between overhangs 22 and 23 through which an adjustment socket 25 may be accessed by a hinge pin which may be inserted into socket 25 as will be more fully described hereinafter.

It should be noted at this time that all of the structures described as part of upper and lower assemblies 12 and 13 may be integrally formed by molding processes well known to one of ordinary skill in the art thereby forming unitary, single-piece assemblies.

Located toward the back of base 14 are a plurality of stepped adjustment brackets 26, one positioned approximately near each rearward corner of lower assembly 13. Brackets 26 are, essentially, stepped support structures which allow both angular and elevational adjustment of upper assembly 12.

Bracket 26 thus includes a plurality of adjustment steps or channels 28, shaped as arcuate links formed at the junction between a back support 29 and a restraining ridge 30. While three discreet channels 28 are shown, it should be appreciated that the number of channels may be varied depending on the intended application. As shown in FIG. 2, the upper two ridges 30 forming the upper two channels 28 may be formed as part of the upper portion of back supports 29. The channel 28 length should be made sufficient to provide adequate mechanical support for the top assembly 12 as will be described more fully hereinafter. In the preferred embodiment, channels 28 may be vertically separated so as to allow adjustment of top assembly 12 in five degree increments with respect to base 14. These values were chosen as providing maximum confort for a large majority of the user population but could be varied depending on a specific need of a particular population.

Lower assembly 13 may include a plurality of reinforcing ribs 31 which provide mechanical strength to base 14 to prevent warpage, bending and other undesirable irregularities when apparatus 10 is under a load condition. Upper assembly 12 likewise may have a plurality of reinforcing ribs if desired.

As best shown in FIG. 1, lower assembly 13 may also include a plurality of rails 32 disposed along inner side walls 18. Rails 32 as shown have a support post 33 which may extend upward and slightly outwardly from side wall 18. Post 33 may be of the same cross-sectional width as side wall 18 to allow lateral flexibility of post 33. Post 33 carries a generally flat track surface 34 which may slope along its longitudinal axis at an angle, with respect to base 14, greater than the maximum angle of adjustment of upper assembly 12. Track 34 extends laterally beyond post 33 to form an eave 35 which should slope along its longitudinal axis at an angle substantailly similar to the slope angle of surface 34. Surface 34 may be beveled downwardly and outwardly to form an engaging surface 36 to ease the installation of upper assembly 12 on top of lower assembly 13. As will be more fully described hereinafter, rails 32 provide a retaining function during adjustment of upper assembly 12 to prevent upper assembly 12 from being lifted too high by the user and thereby possibly damaging the hinge assembly or causing the upper and lower assemblies from separating.

Upper assembly 12 generally includes a platform 38, a plurality of hinge pin assemblies 39, a plurality of guide bars 40 and a plurality of adjustment leg assemblies 41 which cooperate with adjustment brackets 26 to selectively adjust the angle of inclination of surface 38.

Upper assembly 12 provides the principal load area for the user to place his or her feet. As best shown in FIG. 2, upper assembly 12 includes an outer front wall 42 which may slope forward. Front wall 42 extends upwardly and gradually curves as at 43 to begin leveling off and thereafter forming platform 38. A slight angle of inclination of about four degrees is used with platform 38 so that when adjustment legs 41 are engaged with the lowermost adjustment channel 28, platform 38 is inclined at about five degrees with respect to the base. Of course, if desired, platform 38 could be made to be level when adjustment legs 41 are in the lowermost adjustment position but typically some minimal inclination will be desirable in actual use. Platform 38 extends rearwardly and merges with a back cover wall 44. Platform surface 38 may curve somewhat as at 45 to smoothly form a continuous surface with back cover wall 44. Platform 38 may be recessed to form a mat surface 46 which accepts mat 11 thereby maintaining a flush upper surface. Front wall 42 may carry a channel 48 which accepts the forward edge of mat 11, thereby providing a protective surface around the mat edge to prevent the mat edge from catching and accidentally being separated from platform 38.

Depending from the side perimeter of platform 38 are a plurality of outer side walls 49. It will be appreciated by one skilled in the art that upper assembly 12 preferably is of sufficient dimensional area to cover lower assembly 13. Side walls 49 carry a plurality of guide bars 40 which extend inwardly of side walls 49 as shown in the cutaway portion of FIG. 1. Guide bar 40 forms a lip 50 which engages eave surfaces 35 on guide rails 32 if upper assembly 12 is elevated beyond the maximum angle of adjustment, thereby preventing upper assembly 12 completely separating from lower assembly 13 during adjustment or the carrying and transporting of apparatus 10. Surfaces 50 may be generally horizontal with respect to platform 38. It will be appreciated by one skilled in the art that as the back end of upper assembly 12 is raised up from lower assembly 13, surfaces 50 will be inclined. Thusly, as stated previously, eave surfaces 35 are inclined so as to flatly engage surfaces 50. Clearly, each guide bar 40 is so disposed along outer side walls 49 so as to engage its corresponding rail 32 on lower assembly 13. Guide bars 40 may be beveled as at 51. Bevel 51 engages the slides over bevel 36 on rails 32 when upper assembly 12 is initially installed over lower assembly 13. Thus, upper assembly 12 "snaps on" to lower assembly 13 during assembly.

It wil be appreciated by one skilled in the art that the rails 32 disposed toward the back of assembly 13 are somewhat higher than the rails 32 disposed toward the front of assembly 13. This is due to the fact that as upper assembly 12 is lifted as by pivoting about hinge assembly 19, the rearward guide bars 40 will be elevated or inclined higher than the forward guide bars 40. Thus, in order for all the guide bars 40 to properly engage all the guide rails 32 at approximately the same time, the rearward guide rails 32 must be higher, as appropriate.

Hinge pin assembly 39 is shown positioned just behind front wall 42 so as to cooperate with hinge mechanism 19. Pin assembly 39 may be a bar shaped pin 52 which depends from platform 38 as by arms 37 which support pin 52 on either end. During normal use, upper assembly 12 is placed over lower assembly 13, and these two assemblies are joined such that pin 52 passes through slot 24 and into adjustment socket 25. The width of pin 52 may be made larger than the the width of slot 24 (as shown in FIG. 2) so that during normal use pin 52 is retained by socket 25 and cannot lift out of the same through slot 24. Socket 25 preferably has sufficient width and depth to allow substantial horizontal and vertical movement of pin 52 within it, as required to position the adjustment leg assemblies 41 into any one of the adjustment channels 28. It should be apparent that the width of pin 52, when viewed from the front of assembly 10, will be wider than the width of slot 24 so that overhang 22 will not interfere with arms 37.

Adjustment leg assembly 41 includes a front support bar 53 and a rear support bar 54 which depend from mat surface 46 and may be braced together as by bar 55. A channel engagement stem 56 may depend from bar 55 and tapers to a rounded edge 58 which, during angular adjustment of upper assembly 12 by the user, is selectively positioned into one of the adjustment channels 28. Thusly, adjustment leg assembly 41 must be so disposed toward the rear of upper assembly 12 such that edge 58 can selectively engage and cooperate with the uppermost adjustment channel 28 (corresponding to a 15 degree angle of inclination, for example, in the preferred) just before locking pin 52 is blocked by retaining wall 20. Also, edge 58 can selectively engage the lowermost adjustment channel 28 (corresponding to a 5 degree angle of inclination, for example, in the preferred) just before locking pin 52 is blocked by front wall 16. The width of edge 58, as viewed from the front, (as well as the width of channels 28) should be made sufficient to adequately support upper assembly 12 under a load condition.

Operation of apparatus 10 should now be straight-forward to one skilled in the art. In order to utilize minimum elevation and angle of inclination, the user raises upper assembly 12, as by grasping it on either side just rearward of center and lifting, and pulls assembly 12, forward relative to lower assembly 13, thereafter lowering support leg assemblies 41 (specifically edges 58) selectively into the lowermost adjustment channel 28. During this adjustment procedure, upper assembly 12 may pivot on hinge mechanism 19 as by locking pin assembly 39 which is free to move forward, up or down in chamber 25 until blocked by front wall 16. Thus, leg assemblies 41 selectively cooperate with channels 28 to support upper assembly 12 at various angles of inclination with respect to base 14.

Figure 3:
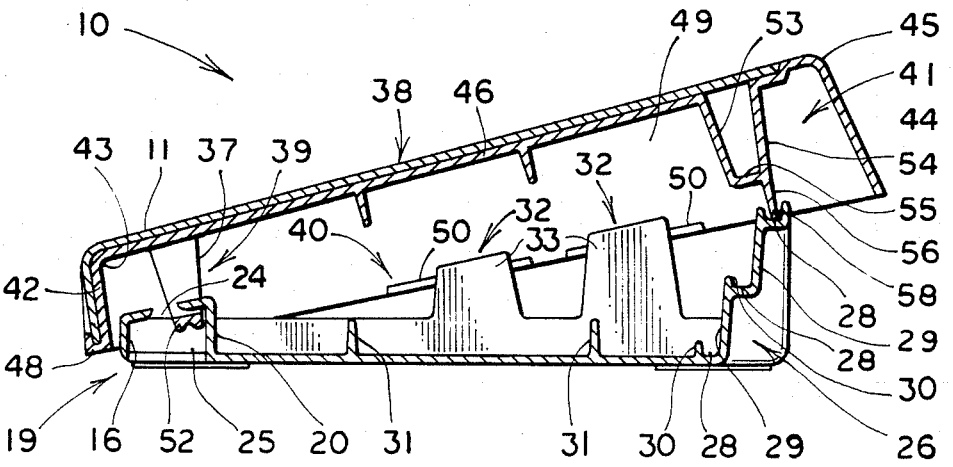
FIG. 3 is a sectional view like FIG. 2 but showing the footrest in an adjusted position.

If, for example, the user desires to utilize the maximum elevation and angle of inclination, upper assembly 12 is raised as described hereinbefore but is moved upward and rearward until the user can selectively position edge 58 into the uppermost channel 28, as in FIG. 3. During this procedure, locking pin 52 has moved rearward within chamber 25 toward retaining wall 20. Retaining wall 20 acts as a stop and prevents the user from accidentally lifting assembly 12 beyond the adjustment positions of lower assembly 13. Also during adjustment, rails 32, in cooperation with guide bars 40, prevent the user from accidentally separating upper and lower assemblies 12, 13 by excessive upward movement. Clearly, rails 32 must be of sufficient height so as not to engage guide bars 40 before the upper-most adjustment channel 28 can be selectively engaged by leg assemblies 41. Overhangs 22 and 23 prevent lifting the front end of upper assembly 12 too far so as to allow assembly 12 to pivot about pin 52. Adjustment channels 28 retain leg assemblies 41 during actual use such that the angle of inclination selected by the user will not change under a load condition. Also, the design described herein allows for simple adjustment with minimal effort required to shift the position of upper assembly 12 relative to lower assembly 13.

It is considered to be within the scope of the present invention that many different configurations of the structures described herein could be used in the alternative. For example, only one single long guide rail on either side of lower assembly 13 could be used rather than the plurality of guide rails 32 used on either side of assembly 13 shown in the preferred. Further, adjustment leg assembly 41 could be a single flat bar depending from platform 38 and locking pin 52 as well as hinges 19 could have many configurations. Also, more adjustment positions could be provided as desired. Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that an apparatus constructed according to the concepts of the present invention, and reasonably equivalent thereto, will accomplish the objects of the present invention and otherwise substantially improve the pertinent art.

We claim:

1. An adjustable foot support comprising a unitary supporting platform, and a unitary base with a plurality of stepped adjustment brackets at one end thereof, said brackets extending upwardly from said base and each of said brackets having a plurality of stepped horizontal channels, means extending downwardly from said platform to selectively cooperate with said stepped channels so that said platform is selectively inclined with respect to said base, and hinge means connecting said supporting platform with said base so that said platform is movably attached to said base, said hinge means including a plurality of overhangs carried by a plurality of walls extending upwardly from said base, said overhang and walls forming a partially enclosed socket, and hinge pin means depending from said platform and located within said socket, said pin means freely movable within said socket and retained therein.

2. An adjustable foot support comprising a unitary supporting platform, and a unitary base with a plurality of stepped adjustment brackets at one end thereof, said brackets including a plurality of supports extending upwardly from said base and joined by a plurality of arcuate links defining a plurality of stepped horizontal channels, means extending downwardly from said platform to selectively cooperate with said arcuate links so that said platform is selectively inclined with respect to said base.

3. A device according to claim 2 wherein said means extending downwardly from said platform is a leg.

4. A device according to claim 2 further comprising hinge means connecting said supporting platform with said base so that said platform is movably attached to said base when said means extending downwardly from said platform selectively engages said stepped channels.

5. A device according to claim 2 further comprising rail means extending upwardly from said base and bar means depending from said support platform, said bar means and said rail means cooperatively defining the maximum elevation and angle of inclination of said platform with respect to said base.

6. A device according to claim 5 wherein said rail means includes an eave carried by a post, said eave outwardly extending from the perimeter of said base, further wherein said bar means includes an inwardly extending lip, said eave and lip positioned so as to engage when said platform is selectively inclined beyond said predetermined angle.

* * * * *